US010349808B2

(12) United States Patent
Fawaz et al.

(10) Patent No.: US 10,349,808 B2
(45) Date of Patent: Jul. 16, 2019

(54) DISHWASHING APPLIANCE HAVING A STATIC JET ASSEMBLY

(71) Applicant: Haier US Appliance Solutions, Inc., Wilmington, DE (US)

(72) Inventors: Bassam Fawaz, Louisville, KY (US); Daniel J. Hart, Louisville, KY (US); John Edward Dries, Louisville, KY (US); Kyle Durham, Louisville, KY (US); Matthew David Mersch, Louisville, KY (US); Glenn Leon Graham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 238 days.

(21) Appl. No.: 15/298,404

(22) Filed: Oct. 20, 2016

(65) Prior Publication Data

US 2018/0110396 A1 Apr. 26, 2018

(51) Int. Cl.
*A47L 15/42* (2006.01)
*A47L 15/50* (2006.01)

(52) U.S. Cl.
CPC ..... *A47L 15/4214* (2013.01); *A47L 15/501* (2013.01); *A47L 15/502* (2013.01); *A47L 15/507* (2013.01)

(58) Field of Classification Search
None
See application file for complete search history.

(56) References Cited

U.S. PATENT DOCUMENTS

| | | | | |
|---|---|---|---|---|
| 5,816,273 | A | 10/1998 | Milocco et al. | |
| 7,523,758 | B2 | 4/2009 | Vanderroest et al. | |
| 9,259,138 | B2 | 2/2016 | Chen et al. | |
| 9,301,670 | B2 | 4/2016 | Dalsing et al. | |
| 2010/0101611 | A1 | 4/2010 | Chen et al. | |
| 2012/0138110 | A1* | 6/2012 | Chen | A47L 15/0018 134/198 |
| 2012/0167927 | A1 | 7/2012 | Shin et al. | |
| 2014/0190525 | A1* | 7/2014 | Porcaro, II | A47L 15/508 134/25.2 |

* cited by examiner

*Primary Examiner* — Rita P Adhlakha
(74) *Attorney, Agent, or Firm* — Dority & Manning, P.A.

(57) ABSTRACT

A dishwashing appliance having a static jet assembly is provided herein. The dishwashing appliance may include a tub defining a wash chamber, a pump, and a spray assembly. The pump may be configured to deliver a wash fluid into the wash chamber. The spray assembly may be housed within the wash chamber of the tub in fluid communication with the pump to receive wash fluid therefrom. The static jet assembly may be disposed within the wash chamber and include a static body. The static body may extend about an exterior hole. The static body may define an interior passage and a jet aperture in fluid communication with the pump. The jet aperture may be defined in fluid communication between the interior passage and the wash chamber.

19 Claims, 13 Drawing Sheets

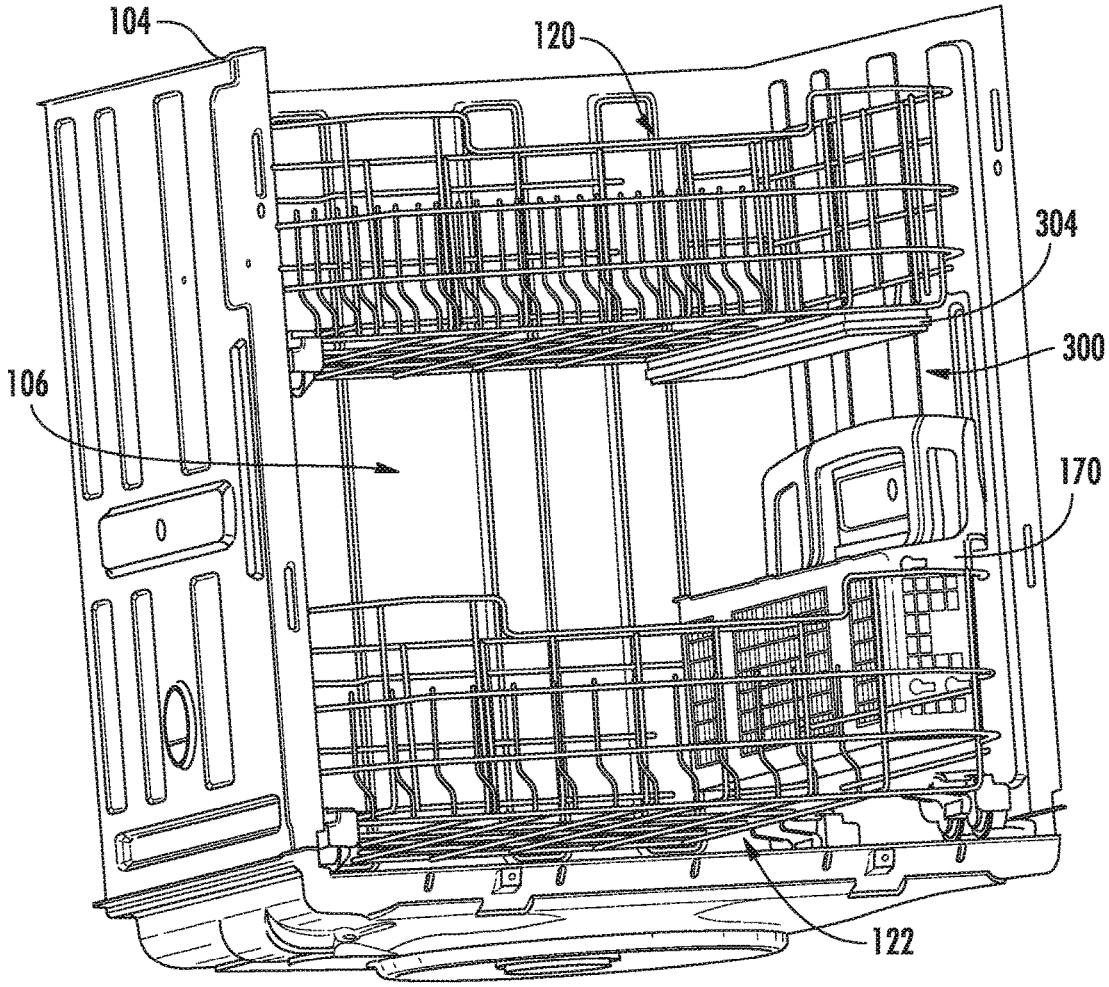
FIG. 15
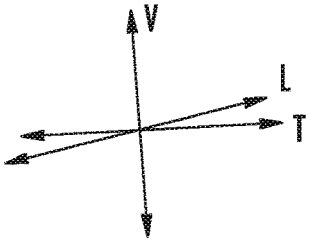

DISHWASHING APPLIANCE HAVING A STATIC JET ASSEMBLY

FIELD OF THE INVENTION

The present subject matter relates generally to washer appliances, and more particularly to dishwashing appliances having one or more static jet assemblies.

BACKGROUND OF THE INVENTION

Dishwashing appliances generally include a tub that defines a wash chamber for receipt of articles for washing. Certain dishwasher assemblies also include a rack assembly slidably mounted within the wash chamber. A user can load articles, such as plates, bowls, glasses, and/or cups, into the rack assembly, and the rack assembly can support such articles within the wash chamber during operation of the dishwashing appliance.

Certain dishwashing appliances also include spray arms for directing wash fluid onto articles within the wash chamber during operation of the dishwashing appliance. The spray arms are generally rotatably mounted with the wash chamber in order to improve wash fluid coverage of articles within the wash chamber. To assist with distributing wash fluid evenly within the wash chamber, the spray arms can include a lower spray arm position below a lower rack assembly, a middle spray arm positioned at a bottom of an upper rack assembly, and an upper spray arm positioned above the upper rack assembly. The lower spray arm is generally configured to clean articles within the lower rack assembly, and the middle and upper spray arms are generally configured to clean articles within the upper rack assembly.

During rotation, spray arms generally define a circular spray area intended to disperse wash fluid across the entire internal footprint of the wash chamber. However, this might allow for certain areas and/or articles of the wash chamber to be neglected. For instance, relatively small articles, such as flatware, within the wash tub, may be largely neglected by the spray supplied by the spray arms. Moreover, relatively large items or a basket for containing the certain articles may block wash fluid from reaching portions of those articles as the spray arms move throughout the wash chamber.

Accordingly, it would be advantageous to provide a static assembly for supplying wash fluid to one or more predetermined locations within the wash chamber. Specifically, it would be useful if such an assembly was configured to provide wash fluid directly to a container or basket for holding articles within the wash chamber of a dishwashing appliance.

BRIEF DESCRIPTION OF THE INVENTION

Aspects and advantages of the invention will be set forth in part in the following description, or may be obvious from the description, or may be learned through practice of the invention.

In one aspect of the present disclosure, a dishwashing appliance is provided. The dishwashing appliance may include a tub defining a wash chamber, a pump, a spray assembly, and a static jet assembly. The pump may be configured to deliver a wash fluid into the wash chamber. The spray assembly may be housed within the wash chamber of the tub in fluid communication with the pump to receive wash fluid therefrom. The static jet assembly may be disposed within the wash chamber and include a static body. The static body may extend about an exterior hole. The static body may define an interior passage and a jet aperture in fluid communication with the pump. The jet aperture may be defined in fluid communication between the interior passage and the wash chamber.

In another aspect of the present disclosure, a dishwashing appliance is provided. The dishwashing appliance may include a tub defining a wash chamber, a pump, a spray assembly, a rack assembly, and a static jet assembly. The pump may be configured to deliver a wash fluid into the wash chamber. The spray assembly may be housed within the wash chamber of the tub in fluid communication with the pump to receive wash fluid therefrom. The rack assembly may be slidably disposed within the wash chamber. The static jet assembly may be disposed within the wash chamber. The static jet assembly may include a static body and a fluid conduit. The static body may be mounted to the rack assembly. The static body may define an interior passage and a jet aperture. The jet aperture may be defined in fluid communication between the interior passage and the wash chamber. The fluid conduit may be fixed to the tub within the wash chamber, the fluid conduit extending in separable fluid communication between the pump and the interior passage.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 15 provides a perspective view of an internal portion of a dishwashing appliance according to other exemplary embodiments of the present disclosure.

DETAILED DESCRIPTION

Figure 1:
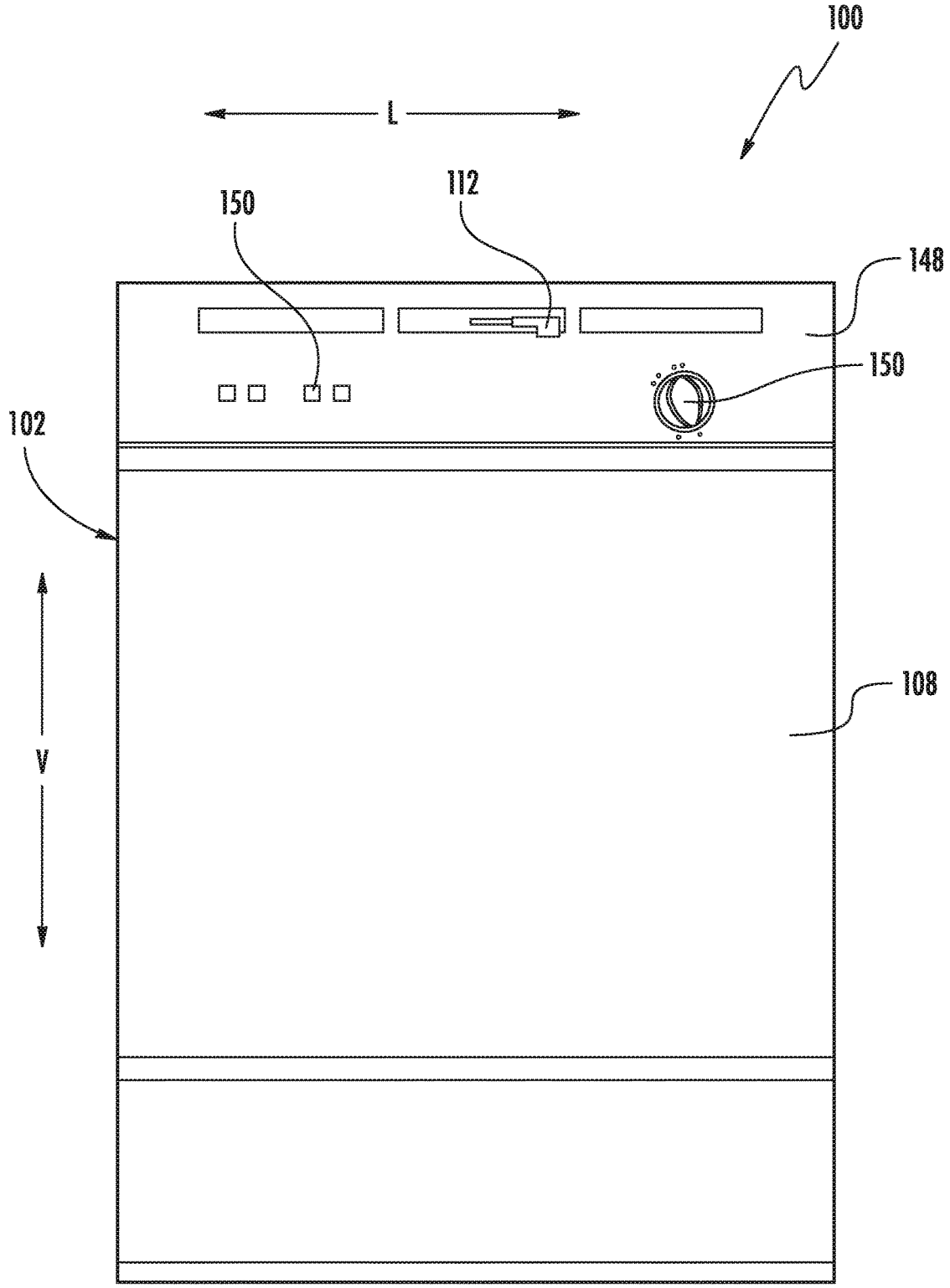
FIG. 1 provides a front view of a dishwashing appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure provides a dishwashing appliance that has a static jet assembly that can provide a focused spray of wash fluid to a predetermined portion of the appliance. The static jet assembly and the basket may be positioned within a rack assembly of the dishwashing appliance to spray utensils within a basket. Wash fluid may supplied from the static jet assembly and directed at an internal portion of the basket.

Figure 2:
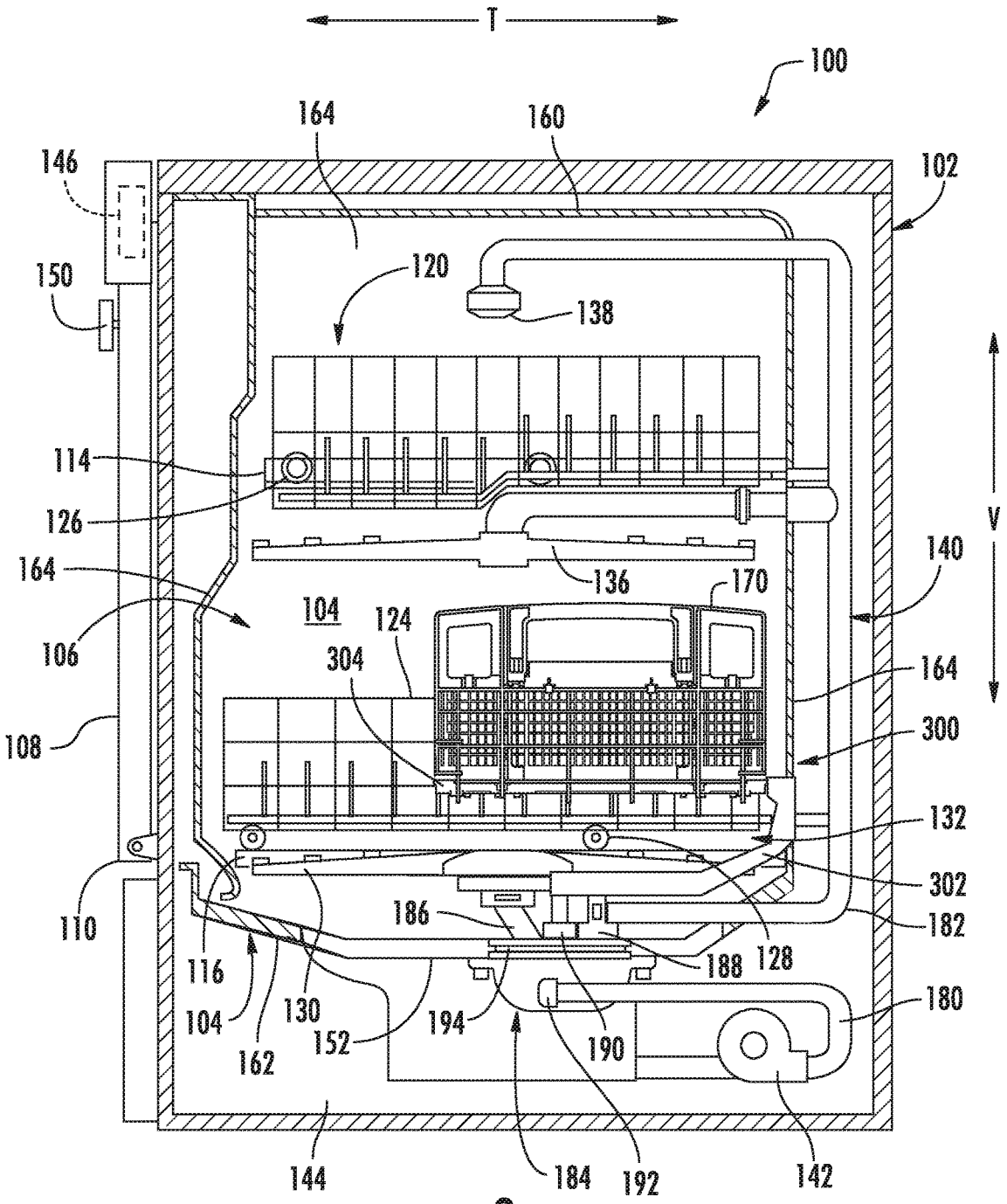
FIG. 2 provides a cross-sectional side view of the exemplary dishwashing appliance of FIG. 1.

Turning now to the figures, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 112 may be used to lock and unlock the door 108 for access to the chamber 106.

The tub 104 may define a discrete vertical direction V, lateral direction L, and transverse direction T. Vertical direction V, lateral direction L, and transverse direction T are orthogonally oriented such that vertical direction V, lateral direction L, and transverse direction T form an orthogonal directional system.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., three sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack 120, 122 is substantially positioned outside the wash chamber 106, and a retracted position (shown in FIGS. 1 and 2) in which the rack 120, 122 is located inside the wash chamber 106. This may be facilitated by rollers 126 and 128, for example, mounted onto racks 120 and 122, respectively.

In some embodiments, a basket 170 is removably mounted to lower rack assembly 122. However, in alternative exemplary embodiments, the basket 170 may also be selectively attached to other portions of dishwashing appliance 100, e.g., upper rack assembly 120 or door 108. The basket 170 defines one or more storage chambers and is generally configured to receive of silverware, flatware, utensils, and the like, that are too small to be accommodated by the upper and lower rack assemblies 120, 122. The basket 170 may be constructed of any suitable material, e.g., metal or plastic, and define a plurality of fluid slots 178 for permitting wash fluid therethrough.

The dishwashing appliance 100 includes one or more spray assemblies housed within the wash chamber 106. For instance, the dishwashing appliance 100 may include a lower spray-arm assembly 130 that is rotatably mounted within a lower region 132 of the wash chamber 106 directly above the bottom wall 162 of the tub 104 so as to rotate in relatively close proximity to the rack assembly 122. As shown in FIG. 2, a mid-level spray-arm assembly 136 may be located in an upper region of the wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142, e.g., to receive a pressurized wash fluid therefrom. Additionally, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of the lower spray-arm assembly 130 provides coverage of dishes and other dishwasher contents with a spray, e.g., a spray of washing fluid.

It should be appreciated that, although the dishwashing appliance 100 will generally be described herein as including three spray assemblies 130, 136, 138, the dishwashing appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwashing appliance 100 may include one or more other spray assemblies and/or wash zones for distributing fluid within the wash chamber 106.

In addition to the three spray assemblies 130, 136, 138, the appliance also includes a static jet assembly 300 disposed within the wash chamber 106. In some embodiments, the static jet assembly 300 may remain generally stationary during use of the dishwashing appliance 100, i.e., such that there is no intentional movement of static jet assembly 300 outside of vibration, etc. In additional or alternative embodiments, one or more movable nozzles (not pictured) may be provided on a static body 304 to rotate during use of the dishwashing appliance 100, e.g., while static body 304 remains stationary.

The static jet assembly 300 may be positioned to direct wash fluid to a certain predetermined location within the wash chamber 106, e.g., a predetermined subsection of the wash chamber 106. For instance, the static jet assembly 300 may be disposed, e.g., on or within the lower rack assembly 122, within the wash tub 104 and directed toward the basket 170. In exemplary embodiments, the static jet assembly 300 may provide advantageously focused cleaning to utensils within the basket 170 without significantly blocking spray from a spray assembly, e.g., lower spray-arm assembly 130.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In such an embodiment, input/output ("I/O") signals may be routed between the control system and various operational components of dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

Additionally, as shown in FIG. 2, a portion of the bottom wall 162 of the tub 104 may be configured as a tub sump portion 152 that is configured to accommodate one or more components of the fluid recirculation assembly 140 (e.g., a filter assembly (not shown) and/or other components). It should be appreciated that, in several embodiments, the bottom wall 162 of the tub 104 may be formed as a single, unitary component such that the tub sump portion 152 as well as the surrounding portions of the bottom wall 162 are formed integrally with one another. Alternatively, the tub sump portion 152 may be configured as a separate component configured to be attached to the remaining portion(s) of the bottom wall 162.

Moreover, as shown in FIG. 2, the fluid recirculation assembly 140 may also include a diverter assembly 184 in fluid communication with the pump 142 for diverting fluid between one or more of the spray-arm assemblies 130, 136, 138. For example, the diverter assembly 184 may, in several embodiments, include an inlet 192 coupled to the pump 142 (e.g., via pump conduit 180 shown in FIG. 2) for directing fluid into the diverter assembly 184 and first and second outlets 186, 188 for directing the fluid received from the pump 142 to the lower spray-arm assembly 130 or the mid-level and upper spray-arm assemblies 136, 138, respectively. In some such embodiments, the first outlet 186 may be configured to be directly coupled to the lower spray-arm assembly 130 and the second outlet 188 may be coupled to a suitable fluid conduit 182 of the fluid recirculation assembly 140 for directing fluid to the mid-level and upper spray-arm assemblies 136, 138. Optionally, a third outlet 190 may be direct the fluid received from the pump 142 to the static jet assembly 300. Additionally, the diverter assembly 184 may also include a diverter valve 194 to selectively divert the flow of fluid through the assembly 184 to the first outlet 186, the second outlet 188, and/or the third outlet 190.

It should be appreciated that the present subject matter is not limited to any particular style, model, or configuration of dishwashing appliance. The exemplary embodiments depicted in FIGS. 1 and 2 are simply provided for illustrative purposes only. For example, different locations may be provided for the user interface 150, different configurations may be provided for the racks 120, 122, and other differences may be applied as well.

Referring now to FIGS. 3 through 14, several view of an example embodiment of the static jet assembly 300, including components thereof, are provided. Static jet assembly 300 may include a fluid conduit 302 and static body 304 in selective fluid communication with pump 142 (FIG. 2). In some embodiments, the basket 170 is positioned and/or mounted proximate to the static jet assembly 300. As illustrated, the basket 170 extends between a first side 171 and a second side 172 along the lateral direction L. The basket 170 also extends between a top 173 and a bottom 174 along the vertical direction V. The basket 170 further extends between a front 175 and a back 176 along the transverse direction T. The fluid slots 178 may be defined between one or all of the areas between the sides 171 and 172, the top 173 and bottom 174, or the front 175 and back 176. Optionally, the basket 170 may include a handle 179 extending, e.g., in the vertical direction V, from the top 173 for convenient removal from and/or insertion into a rack assembly.

Figure 3:
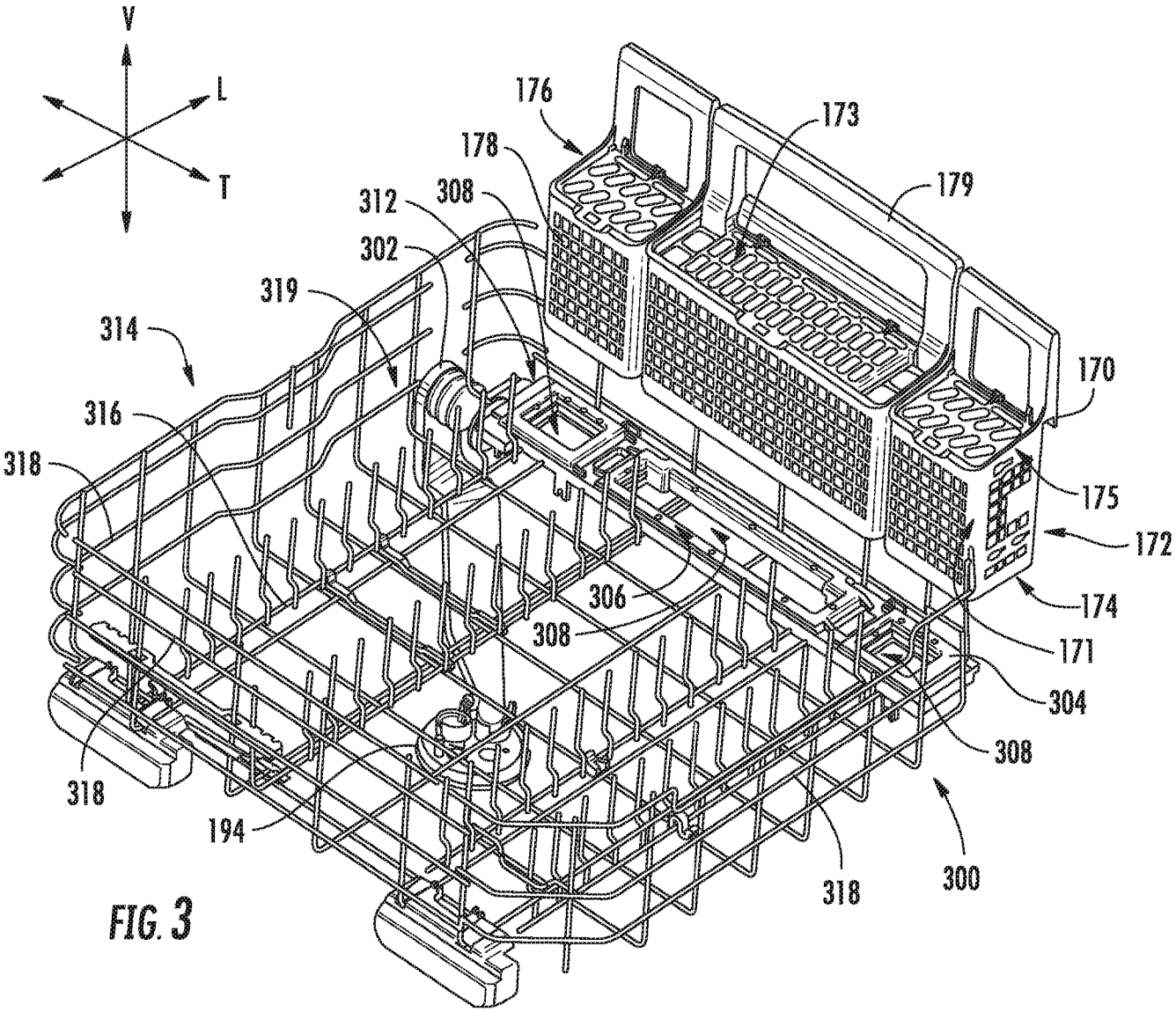
FIG. 3 provides an exploded perspective view of several components of the exemplary dishwashing appliance of FIG. 2, including a rack assembly and static jet assembly.
Figure 4:
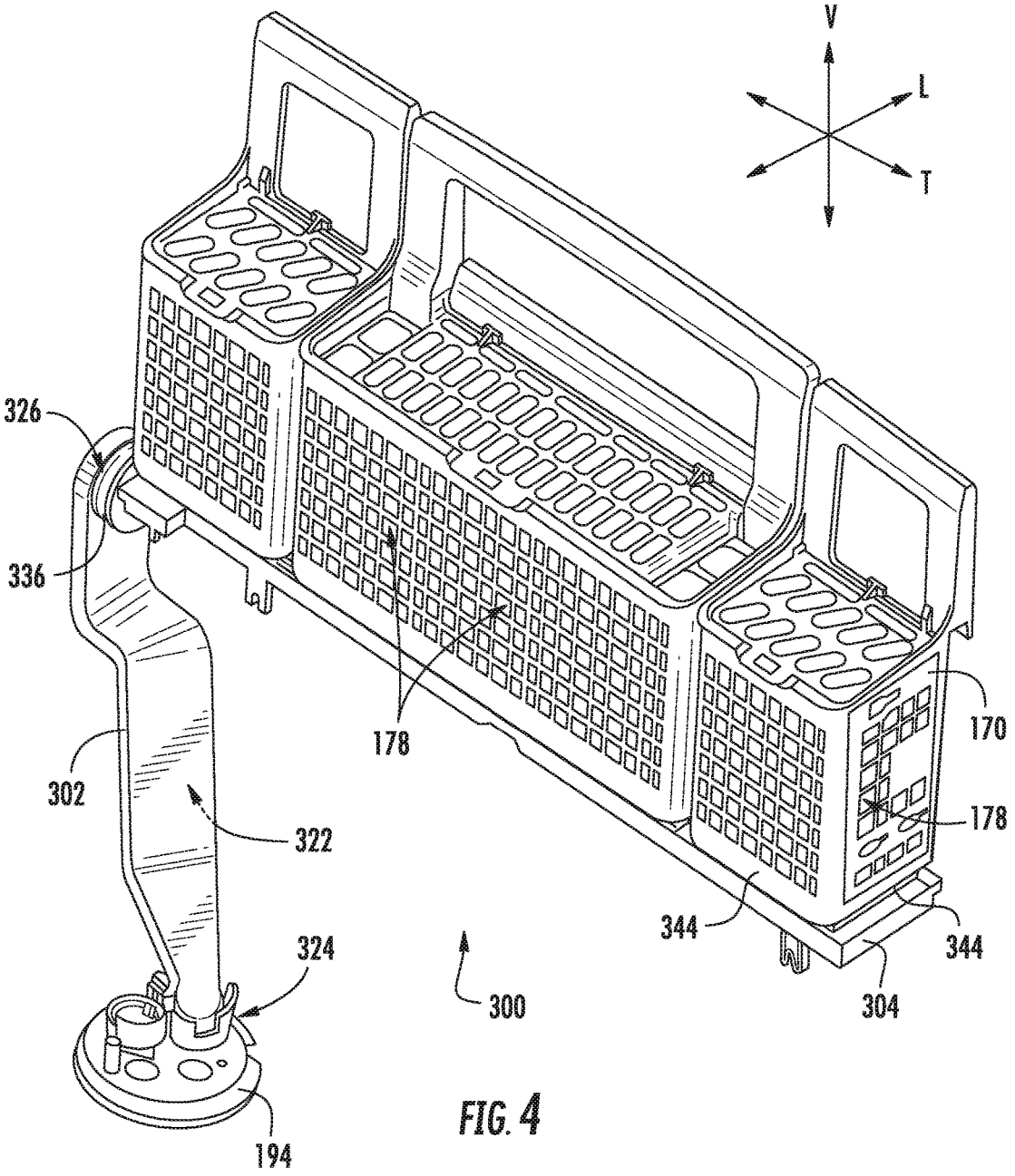
FIG. 4 provides a perspective view of the exemplary static jet assembly of FIG. 3.

As illustrated in FIGS. 3 and 4, the static jet assembly 300 includes a static body 304 defining an interior passage 306 to direct wash fluid from the fluid conduit 302. The static body 304 may include an upper face 310 that defines a plurality of jet apertures 312. Optionally, static body 304 may extend about one or more exterior holes 308. The jet apertures 312 may be in fluid communication between the interior passage 306 and the wash chamber 106 (FIG. 2). During use, wash fluid may thus be directed into the wash chamber 106 from the jet apertures 312, e.g., after passing into the interior passage 306 from the fluid conduit 302.

In some embodiments, at least a portion of the static jet assembly 300, e.g., the static body 304, is mounted to a rack assembly 314. It should be noted that the rack assembly 314 may be embodied as a lower rack assembly 122 or an upper rack assembly 120, as illustrated in FIG. 2. In turn, in some embodiments wherein the rack assembly 314 is a lower rack assembly 122, the upper rack assembly 120 will be disposed above the rack assembly 314. The rack assembly 314 may generally include a bottom wall 316 and a plurality of side walls 318 defining a wash compartment 319 for receiving articles to be washed. Each wall 316, 318 may be formed from a lattice structure, as described above. Optionally, the wash compartment 319 may receive the basket 170 therein. Additionally or alternatively, the wash compartment 319 may receive the static body 304. For instance, static body 304 may be mounted to one or more of the walls 316, 318 within the wash compartment 319 such that the jet apertures 312 are directed, e.g., in the vertical direction V, into a portion of the wash compartment 319, as will be described below.

Figure 5:
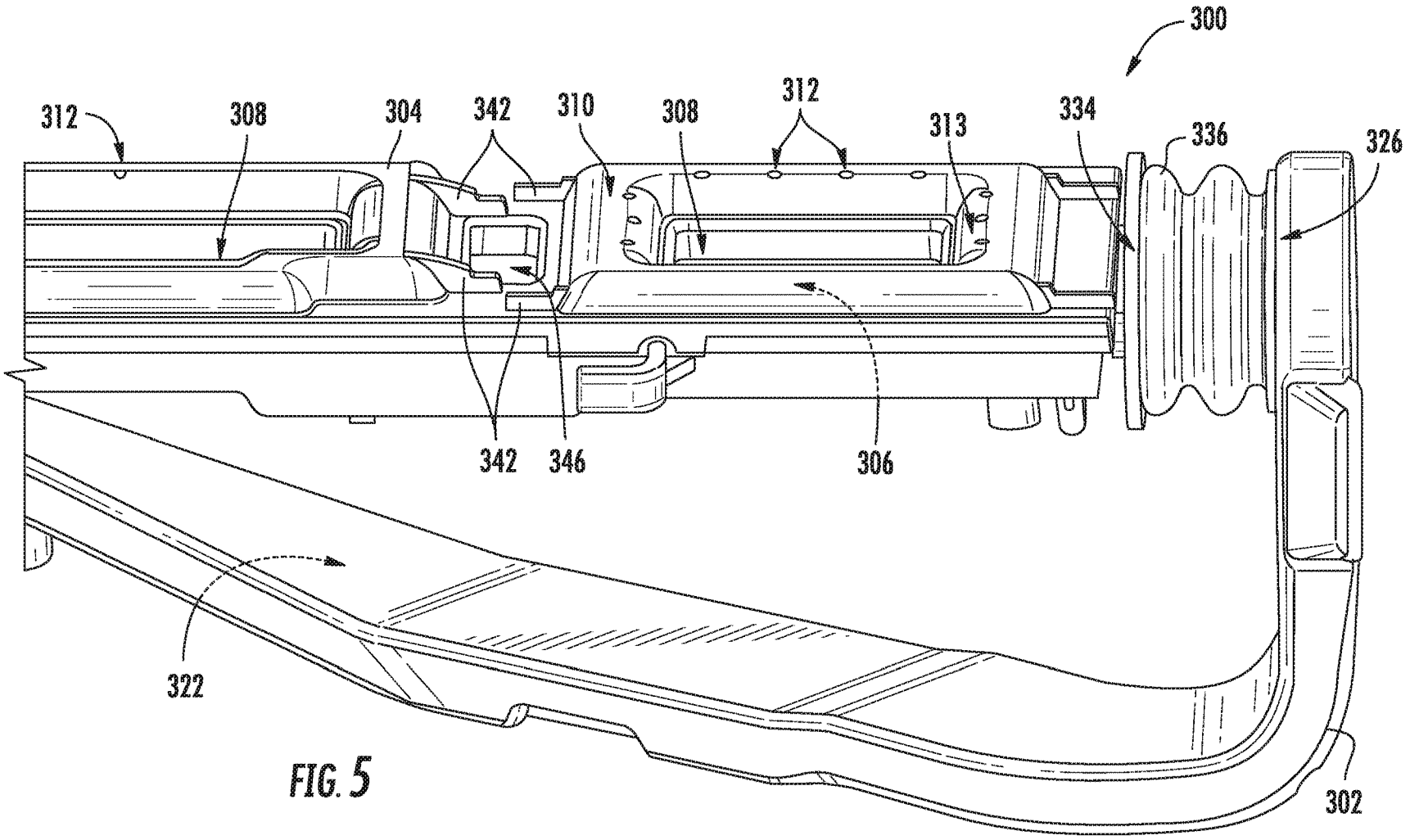
FIG. 5 provides a magnified perspective view of a portion of the exemplary static jet assembly of FIG. 3.
Figure 6:
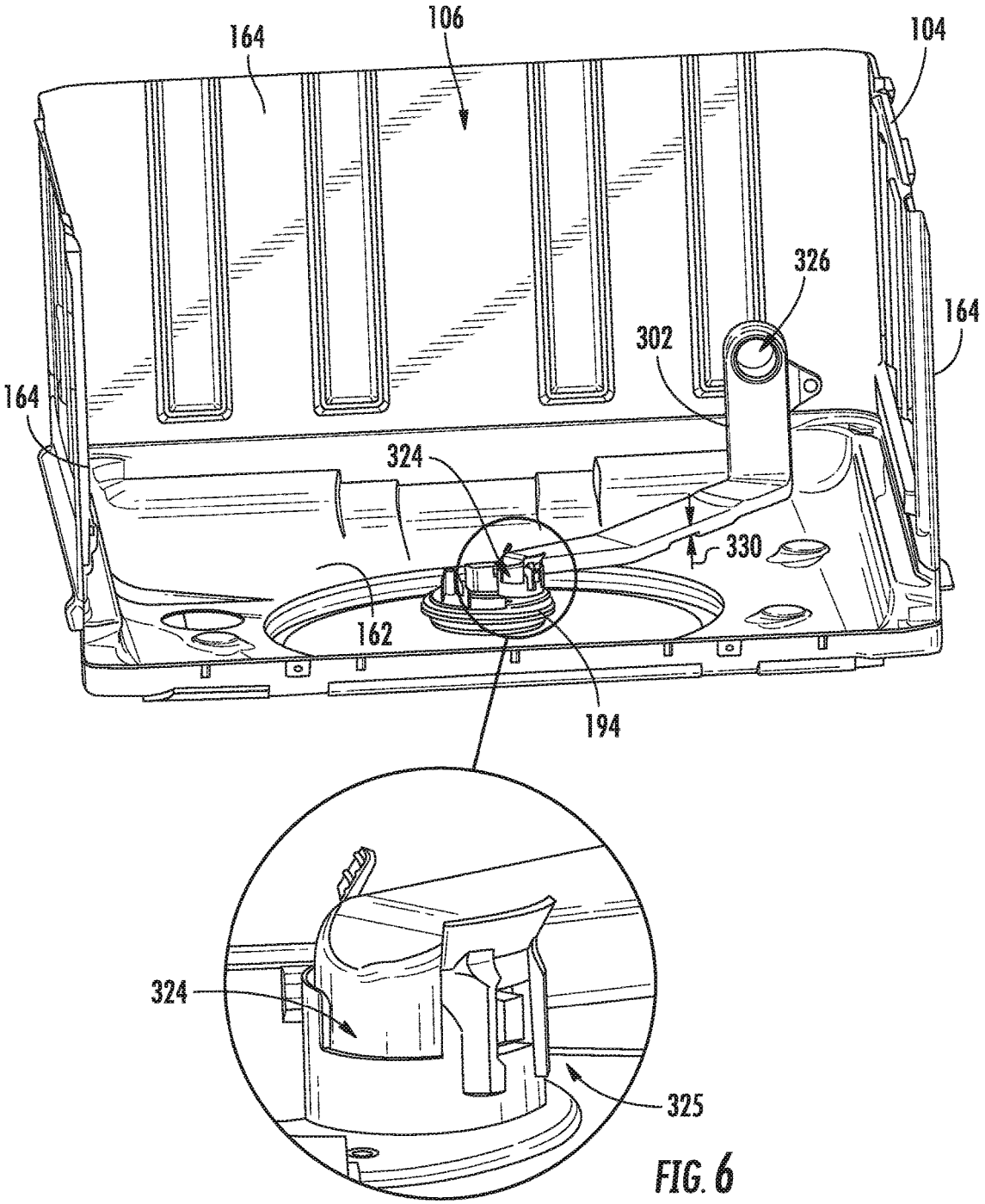
FIG. 6 provides a perspective view of a portion of the exemplary dishwashing appliance of FIG. 2, including a magnified view of a portion of a fluid conduit.
Figure 7:
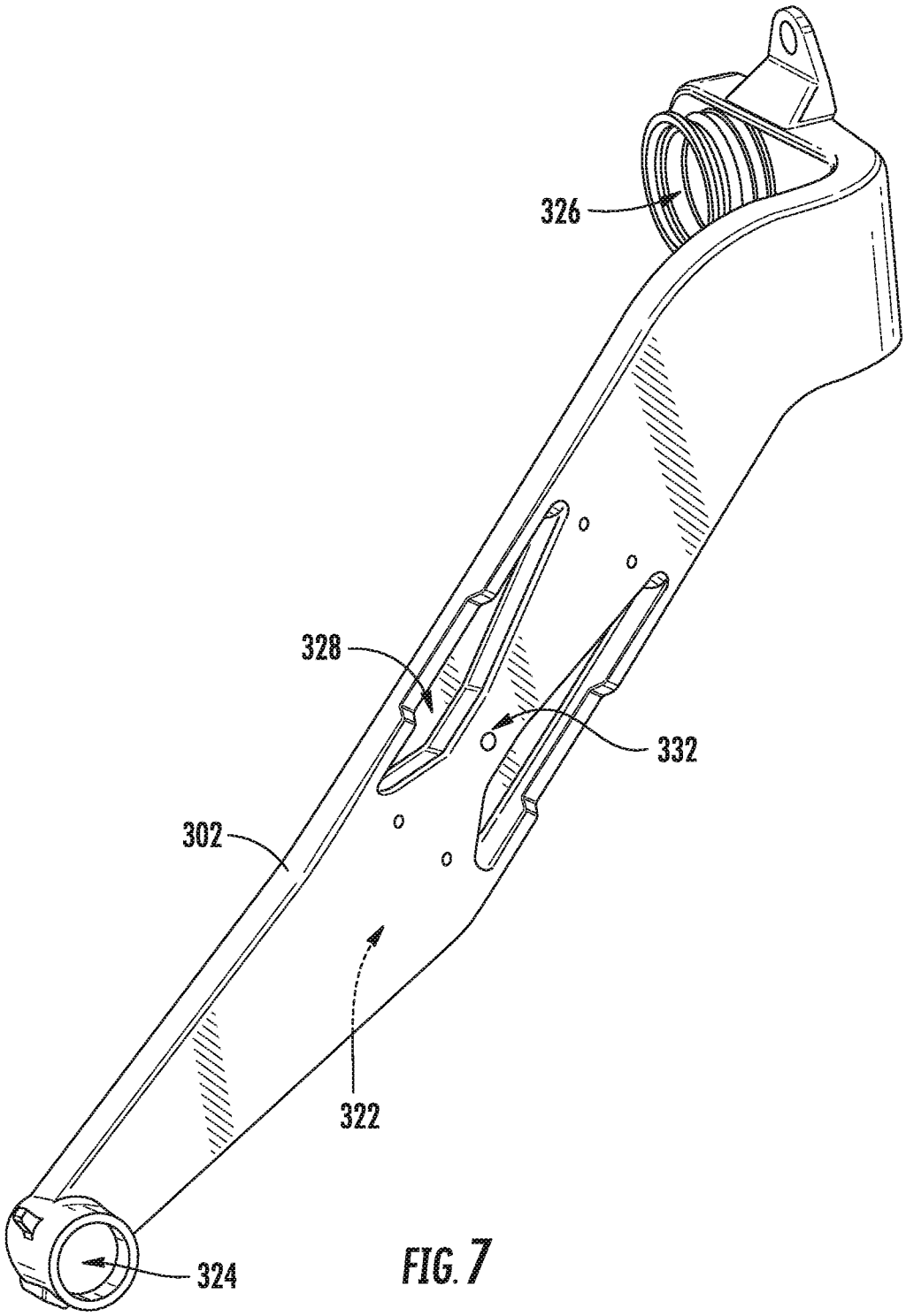
FIG. 7 provides a bottom perspective view of the fluid conduit of the exemplary dishwashing appliance of FIG. 2.
Figure 8:
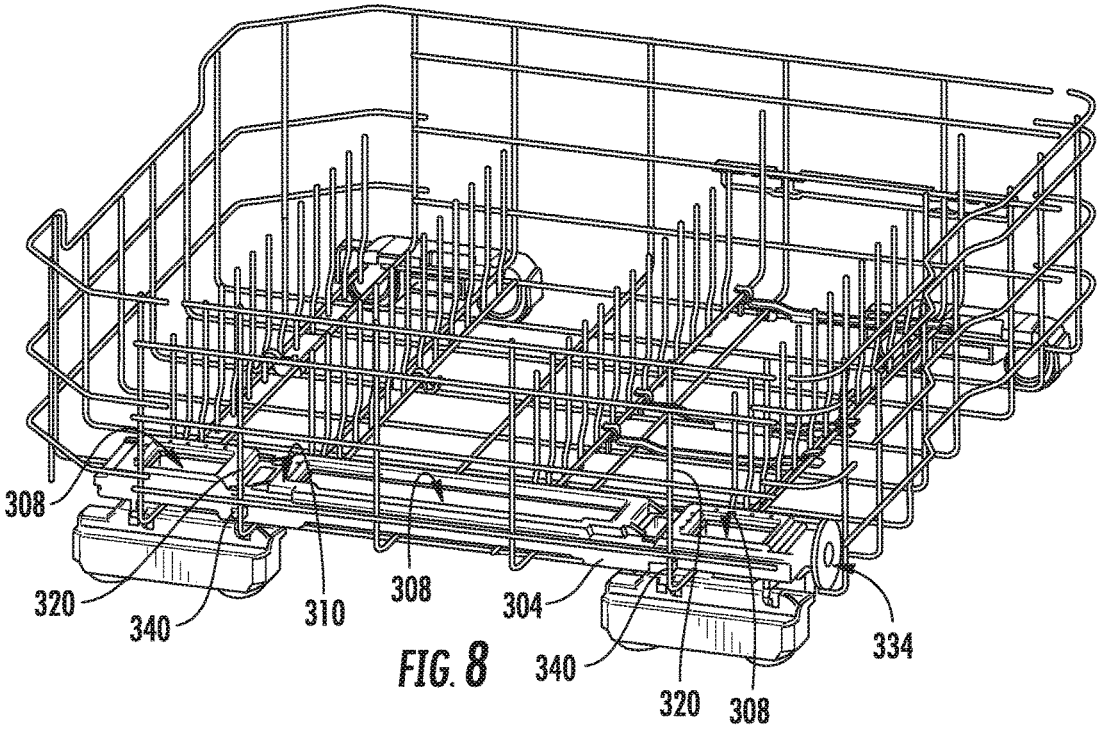
FIG. 8 provides a perspective view of several components of the exemplary dishwashing appliance of FIG. 2, including a rack assembly and static jet assembly wherein a basket has been removed.
Figure 9:
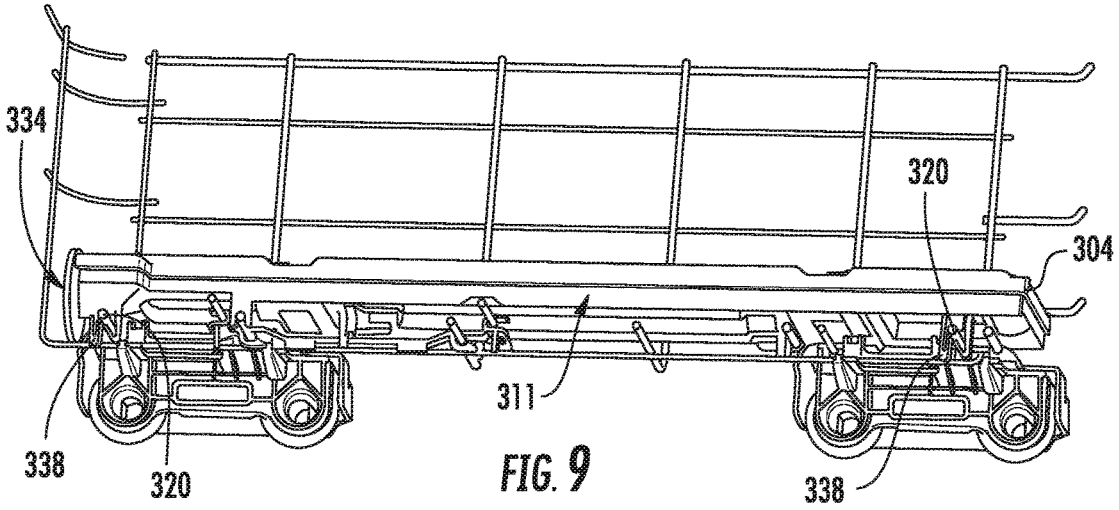
FIG. 9 provides a cross-sectional perspective view of several components of the exemplary dishwashing appliance of FIG. 2, including a rack and static jet assembly wherein a basket has been removed.
Figure 10:
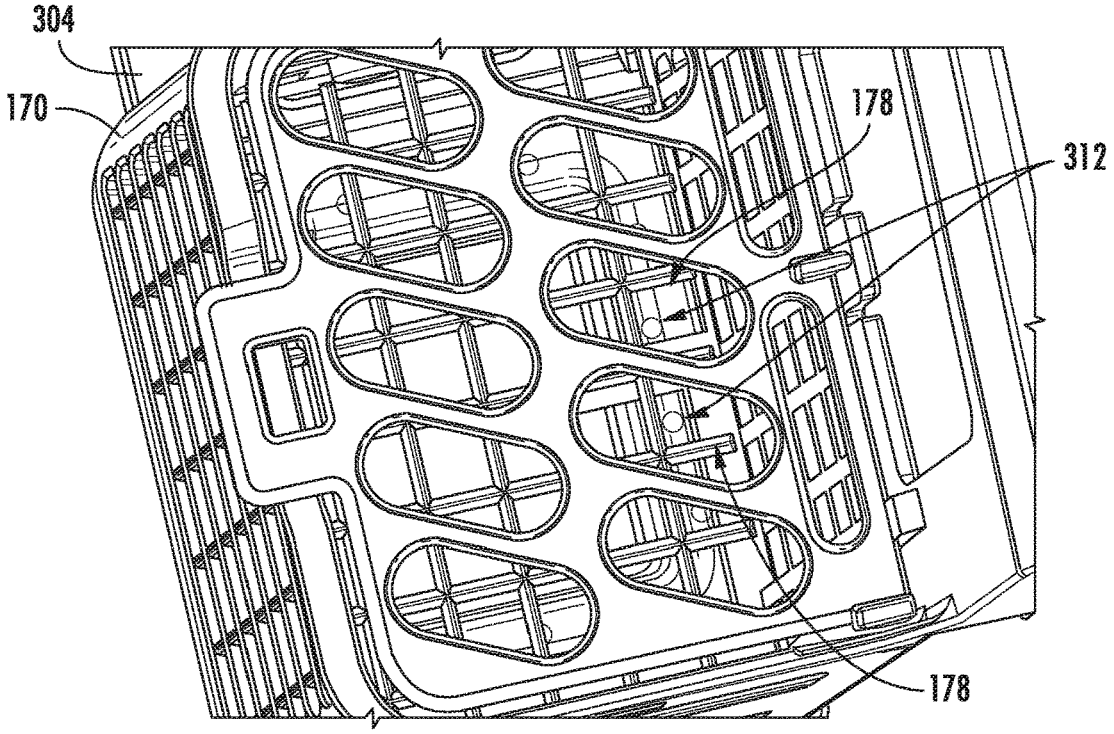
FIG. 10 provides a magnified top perspective view of a portion of the exemplary static jet assembly of FIG. 3, including a basket disposed thereon.
Figure 11:
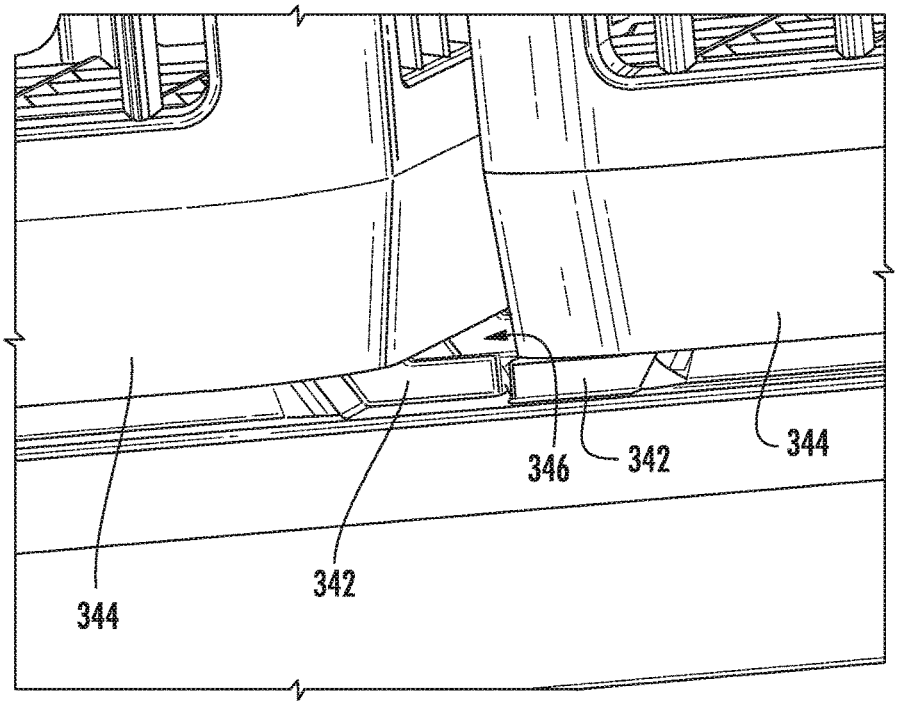
FIG. 11 provides a magnified bottom perspective view of a portion of the exemplary static jet assembly of FIG. 3, including a basket disposed thereon.
Figure 12:
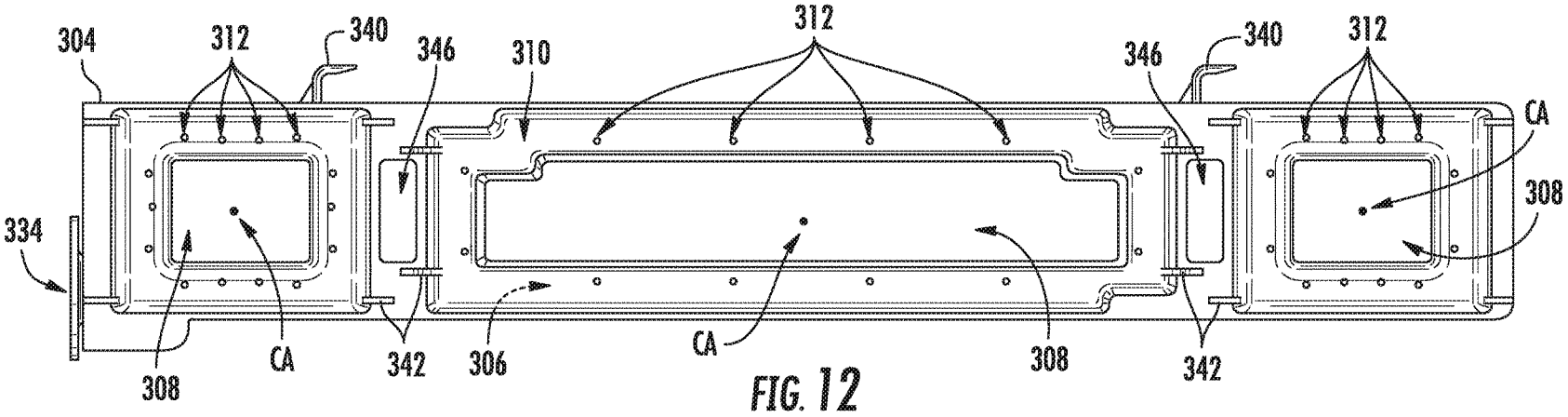
FIG. 12 provides a top view of a static body of the exemplary static jet assembly of FIG. 3.
Figure 13:
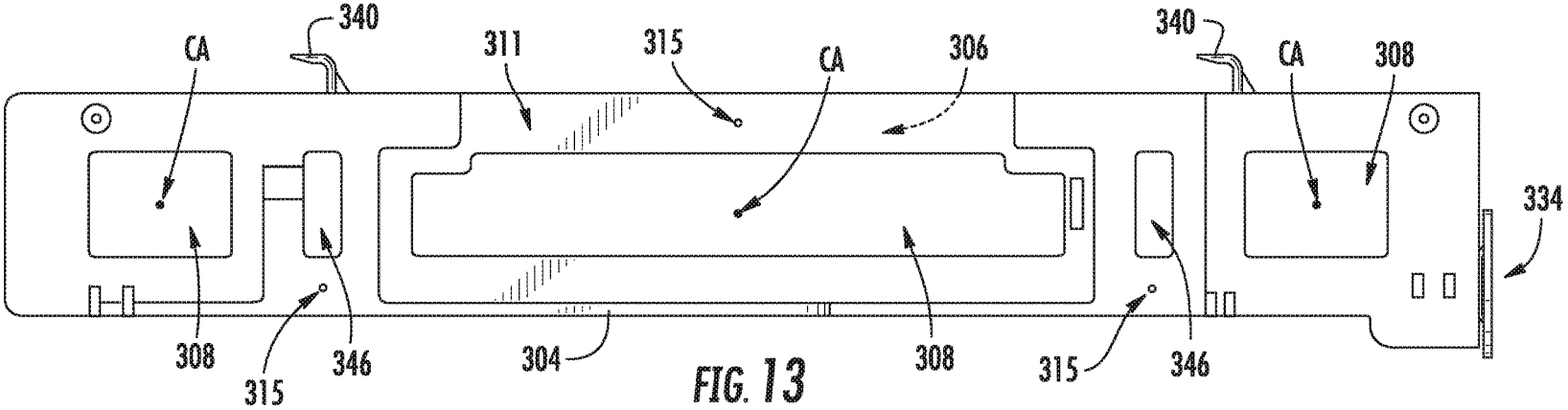
FIG. 13 provides a bottom view of a static body of the exemplary static jet assembly of FIG. 3.
Figure 14:
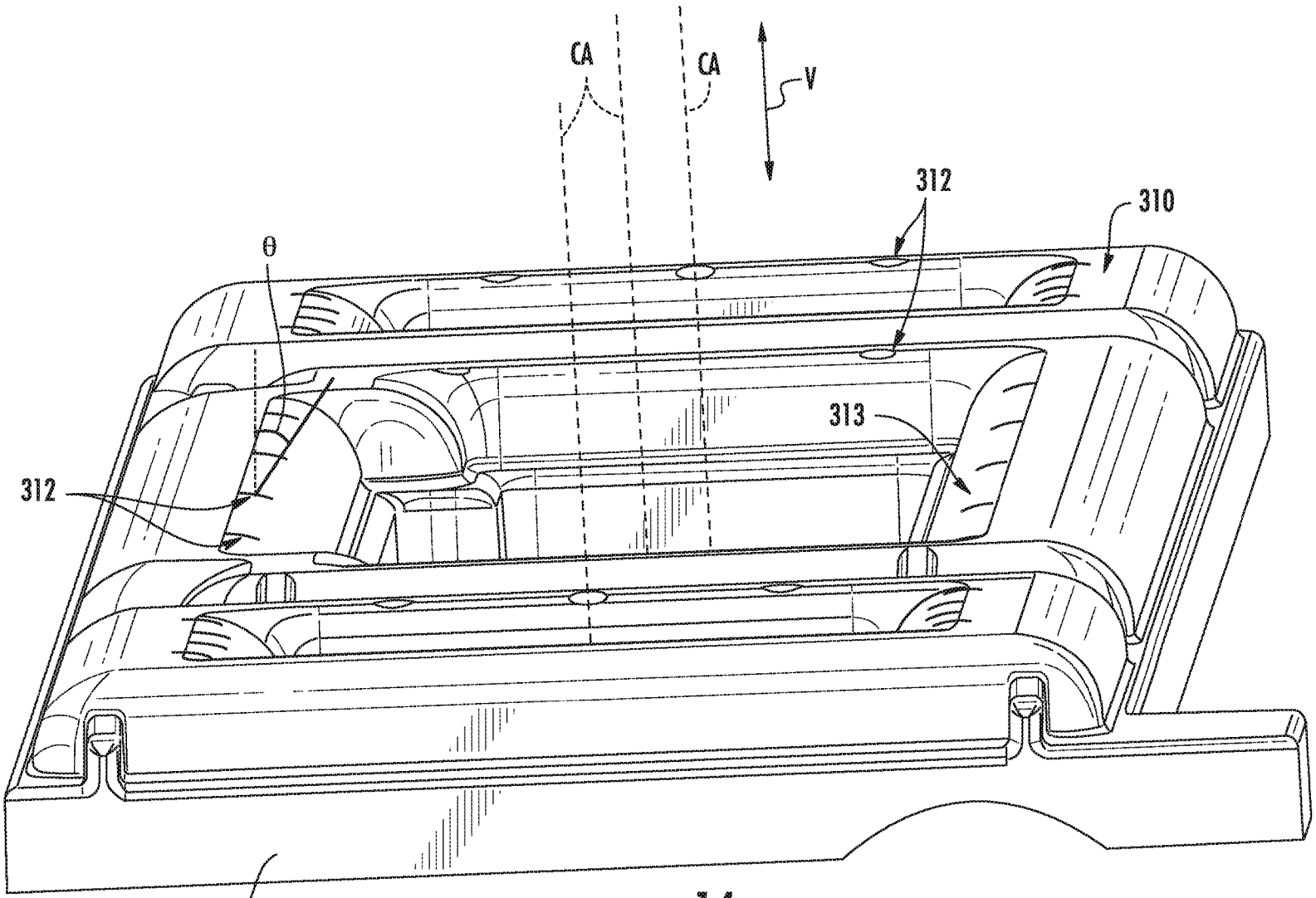
FIG. 14 provides a side perspective view of a portion of the static body of the exemplary static jet assembly of FIG. 3.

As illustrated in FIGS. 5 through 7, the fluid conduit 302 may be provided in selective fluid communication with the static body 304. When assembled, the fluid conduit 302 is generally disposed inside the tub 104. Specifically, the fluid conduit 302 may be fixed to the tub 104 within the wash chamber 106. In some such embodiments, the fluid conduit 302 is mounted to the tub 104 via one or more mechanical fasteners (e.g., bolts, clasps, screws, ties, etc.). The fluid conduit 302 may define a conduit passage 322 extending between a conduit inlet 324 and a conduit outlet 326, e.g., to direct wash fluid therethrough. The conduit inlet 324 may be attached to the diverter valve 194 to selectively receive wash fluid from the pump 142 (FIG. 2), as described above. For instance, a pair of male-female tabs 325 may be provided at the conduit inlet 324 to removably secure the fluid conduit 302 to the diverter valve 194. The conduit outlet 326 may selectively attach to the static body 304, as will be described below.

In some embodiments, the conduit passage 322 includes a Venturi portion 328 (see FIG. 7). The Venturi portion 328 may increase pressure of wash fluid upstream therefrom, while increasing the velocity of wash fluid being directing through the Venturi portion 328. Advantageously, the increased velocity of wash fluid being directed through the Venturi portion 328 may reduce the amount of washing liquid that might otherwise leak, e.g., from the drain hole 332 during operation.

An air gap 330 may be defined, e.g., in the vertical direction V, between a bottom portion of the fluid conduit 302 and a wall of the tub 104. For instance, as illustrated, the air gap 330 may be defined between the fluid conduit 302 and the bottom wall 162. Optionally, a drain hole 332 may be defined through the fluid conduit 302, e.g., at the bottom portion of the fluid conduit 302. The drain hole 332 may be in fluid communication between the conduit passage 322 and the wash chamber 106 and/or air gap 330. In certain embodiments, the drain hole 332 is defined through the fluid conduit 302 along the Venturi portion 328. Once pressurized wash fluid is no longer supplied to the fluid conduit 302, e.g., from the pump 142 (FIG. 2), wash fluid remaining in the conduit passage 322 may flow to the wash chamber 106 through the drain hole 332, e.g., as motivated by gravity and the shape of the fluid conduit 302.

As noted above, the fluid conduit 302 may selectively attach to the static body 304. Specifically, the static body 304 defines an inlet 334 that may be separably connected to the fluid conduit 302, e.g., at the conduit outlet 326. The connection between the static body 304 and the fluid conduit 302 may be alternately formed and broken as the static body 304 slides into and out of the wash chamber 106, e.g., with the rack assembly 314 (FIG. 3). In certain embodiments, the fluid conduit 302 includes a resilient bellow 336 extending from the conduit outlet 326. The resilient bellow 336 may extend toward the inlet 334, e.g., in contact with the inlet 334. The resilient bellow 336 may be formed to generally compress when engaged with the static body 304. Conversely, the resilient bellow 336 may expand outward, e.g., away from the outlet 326 of the fluid conduit 302 when the static body 304 is removed from engagement therewith. When connected, wash fluid may flow from the conduit outlet 326, through the resilient bellow 336, and to the inlet 334. The resilient bellow 336 may be formed from a suitable elastic material, such as one or more plastic or rubber material.

As illustrated in FIGS. 8 through 14, the static body 304 may be mounted to one or more of the walls 316, 318 within the wash compartment 319. In certain embodiments, the static body 304 rests on the bottom wall 316 of the rack assembly 314. For instance, a lower face 311, which is positioned opposite to the upper face 310 (e.g., in the vertical direction V), may engage the bottom wall 316 of the rack assembly 314. Optionally, one or more mounting features secure the static body 304 to the rack assembly 314. For instance, one or more clips 338 may secure the static body 304 to a lattice member 320 along the bottom wall 316. Additionally or alternative, a hook 340 may extend over a lattice member 320 along a side wall 318 and laterally secure the static body 304 thereto.

In some embodiments, the basket 170 is disposed on the static body 304. Optionally, the static body 304 may be formed to complement the shape and/or perimeter of the basket 170. At least a portion of basket 170 may extend across the upper face 310. One or more support ridges 342 may extend from the upper face 310, e.g., in the vertical direction V. A lower rim 344 may extend from the bottom 174 of the basket 170, e.g., in the vertical direction V about a perimeter portion of the bottom 174. The basket 170 may be positioned on the static body 304 such that the support ridges 342 engage the lower rim 344. When assembled, the upper face 310 may be spaced apart from the bottom 174 of the basket 170. A channel 346 may be defined between the upper face 310 and the basket 170. Wash fluid may fall or drain from the basket 170 through the channel 346, and across around the upper face 310, and to the lower face 311. Falling wash fluid from the basket 170 is thus directed away from the interior passage 306 of the static body 304. Optionally, one or more of the jet apertures 312 may be aligned with the fluid slots 178 of the basket 170. In some such embodiments, each of the plurality of jet apertures 312 is aligned in fluid communication with a discrete slot 178 of the plurality of fluid slots 178. During operations of the static jet assembly 300, wash fluid may pass unimpeded from each jet aperture 312 to an internal portion or storage chamber of the basket 170.

In optional embodiments, one or more drain holes 315 are defined through the static body 304, e.g., at the lower face 311. The drain hole(s) 315 may be in fluid communication between the interior passage 306 and the wash chamber 106 (FIG. 2). Once pressurized wash fluid is no longer supplied to the static body 304, e.g., from the pump 142 (FIG. 2), wash fluid remaining in the interior passage 306 may flow to the wash chamber 106 through the drain hole 315, e.g., as motivated by gravity and the shape of the static body 304.

As shown, the jet apertures 312 may be defined at an angle, e.g., such that wash fluid therefrom is directed along the same angle. In certain embodiments, one or more of the plurality of jet apertures 312 are defined at an angle θ relative to the vertical direction V. For instance, each jet aperture 312 may be defined along a surface radius 313 of upper face 310 such that wash fluid is dispensed at the angle θ. Each angle θ may be defined relative to the vertical direction V. One or more jet aperture 312 may be defined at an angle θ between 20° and 80°. In certain embodiments, each of the plurality of jet apertures 312 is defined at an angle θ between 40° and 70°. The angle θ of each jet aperture 312 may be identical to or distinct from the other apertures 312. In other words, each angle θ may be identical to or distinct of each other angle θ.

Some embodiments of static body 304 extend about one or more exterior holes 308. Each exterior hole 308 may extend along a central axis CA, e.g., parallel to the vertical direction V from the upper face 310 of the static body 304 to the lower face 311 of the static body 304. Exterior hole 308 may thus provide a void through which fluid may pass, independent of the jet apertures 312.

In some embodiments, the jet apertures 312 are radially disposed about one or more exterior holes 308. Optionally, one or more of the plurality of jet apertures 312 are defined at an angle θ directed toward the central axis CA. Each angle θ may thus be defined relative to the central axis CA. One or more jet aperture 312 may be defined at an angle θ between 20° and 80°. In certain embodiments, each of the plurality of jet apertures 312 is defined at an angle θ between 40° and 70°. The angle θ of each jet aperture 312 may be identical to or distinct from the other apertures 312. In other words, each angle θ may be identical to or distinct of each other angle θ.

As noted above, the static body 304 may be formed to complement the shape of the basket 170. For instance, in exemplary embodiments wherein the basket 170 has three distinct storage chambers (such as the embodiments shown in FIGS. 3 and 4), the static body 304 may include three distinct exterior holes 308. Each exterior hole 308 may be defined along a distinct central axis CA. Moreover, a unique set of jet apertures 312 may be radially disposed about each central axis CA and directed thereto, e.g., toward a respective chamber of the basket 170.

During use, wash fluid, e.g., from the lower spray assembly 130, may advantageously flow through the exterior hole(s) 308 without hindering the flow of wash fluid from the jet apertures 312. In certain embodiments wherein multiple exterior holes 308 are defined, the central axis CA of each exterior hole 308 may be parallel to the others. Additionally or alternatively, one or more central axes CA may be parallel to the vertical direction V.

Although the embodiments of FIGS. 2 through 14 provide a static jet assembly 300 attached to a bottom rack assembly 122, alternative embodiments may provide the static jet assembly 300 at another suitable location. For instance, exemplary embodiments similar to the embodiment of FIG. 15 provide a static body 304 attached to an upper rack assembly 120. Specifically, the static body 304 is mounted to an underside portion of the upper rack assembly 120. The jet apertures 312 may each be directed toward the lower rack assembly 122, e.g., the basket 170 disposed within the lower rack assembly 122.

Figure 16:
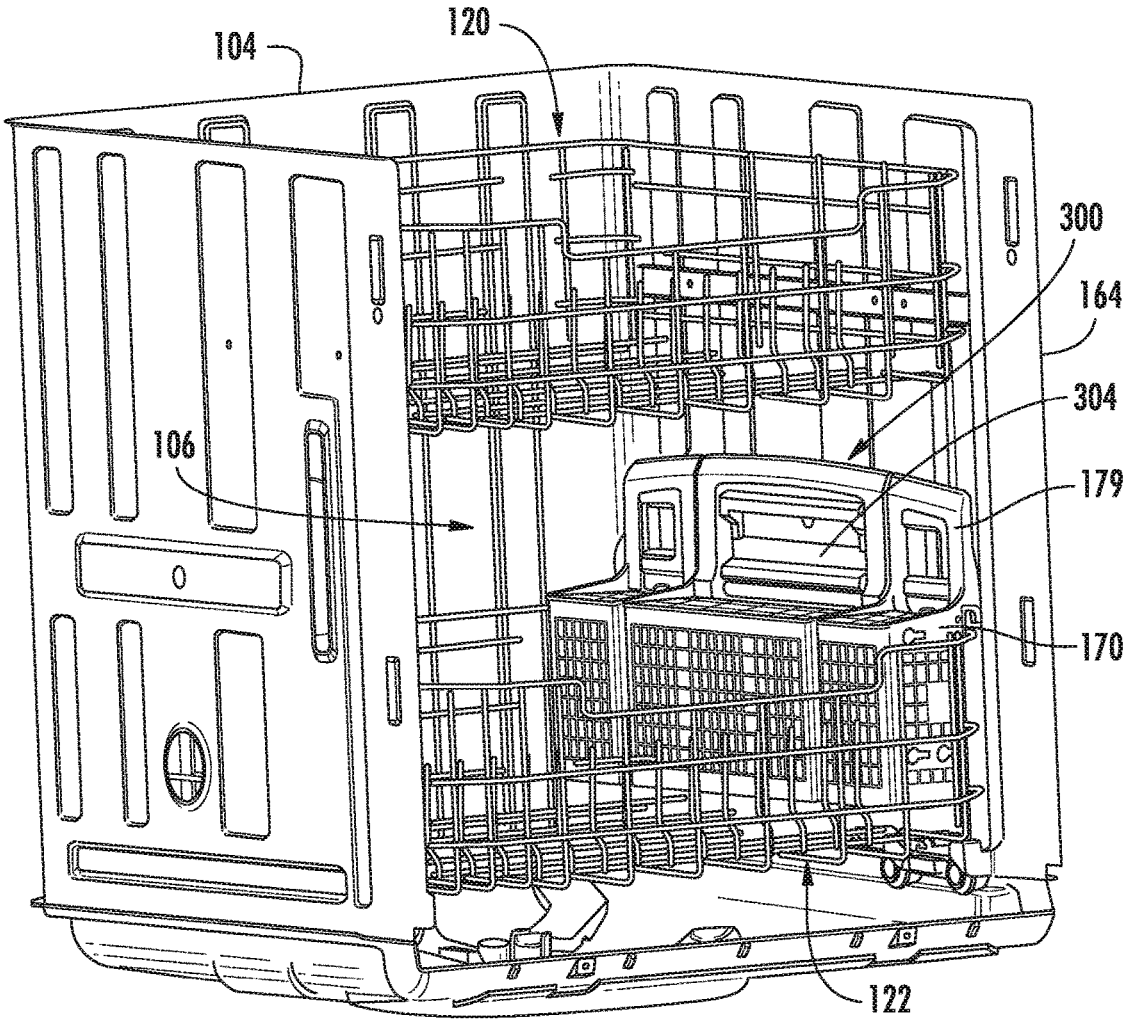
FIG. 16 provides a perspective view of an internal portion of a dishwashing appliance according to yet other exemplary embodiments of the present disclosure.
Figure 16:
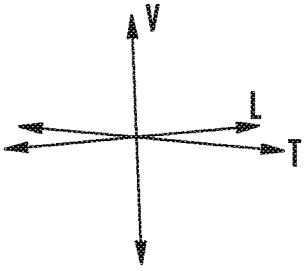

In alternative exemplary embodiments similar to the embodiment of FIG. 16, a static body 304 is attached to basket 170 above the wash compartment of lower rack assembly 122. Specifically, the static body 304 is mounted to the handle 179 of the basket 170. Alternatively the static body 304 is mounted directly to a sidewall 164 of the tub 104. The jet apertures 312 may each be directed laterally, e.g., toward an area of the wash chamber 106 between the lower rack assembly 122 and the upper rack assembly 120.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance comprising:

a tub defining a wash chamber;

a pump configured to deliver a wash fluid into the wash chamber;

a spray assembly housed within the wash chamber of the tub in fluid communication with the pump to receive wash fluid therefrom; and a static jet assembly disposed within the wash chamber, the static jet assembly comprising a static body extending about an exterior hole such that the static body defines an enclosed perimeter shape of the exterior hole, the static body defining an interior passage and a jet aperture in fluid communication with the pump, the jet aperture being defined in fluid communication between the interior passage and the wash chamber, wherein the exterior hole defines a void through which fluid may pass, independent of the jet aperture and the pump.

2. The dishwashing appliance of claim 1, wherein the exterior hole defines a central axis parallel to the exterior hole and radially inward from the static body, and wherein the jet aperture is defined at a non-parallel angle directed toward the central axis.

3. The dishwashing appliance of claim 1, further comprising:

a basket disposed within the wash chamber, the basket defining a plurality of fluid slots, wherein the jet aperture is directed toward the basket.

4. The dishwashing appliance of claim 3, wherein the static body further defines a plurality of jet apertures, and wherein each of the plurality of jet apertures is aligned in fluid communication with a discrete slot of the plurality of fluid slots.

5. The dishwashing appliance of claim 3, wherein the static body includes an upper face and a support ridge, wherein the support ridge extends in a vertical direction from the upper face in engagement with a bottom portion of the basket, and wherein the upper face is spaced apart from the bottom portion of the basket.

6. The dishwashing appliance of claim 1, further comprising;

a fluid conduit fixed to the tub within the wash chamber, the fluid conduit extending in fluid communication between the pump and the interior passage.

7. The dishwashing appliance of claim 6, wherein the static body defines an inlet separably connected to the fluid conduit.

8. The dishwashing appliance of claim 7, wherein the fluid conduit includes a resilient bellow extending toward the inlet in fluid communication therewith.

9. The dishwashing appliance of claim 1, further comprising:

a rack assembly slidably disposed within the wash chamber above the spray assembly, wherein the static body is mounted to the rack assembly.

10. The dishwashing appliance of claim 9, wherein the jet aperture is defined at a non-parallel angle relative to a vertical direction.

11. The dishwashing appliance of claim 9, further comprising:

a basket disposed within the wash chamber, the basket defining a plurality of fluid slots, wherein the jet aperture is directed toward the basket.

12. The dishwashing appliance of claim 11, wherein the static body includes an upper face and a support ridge extending in a vertical direction from the upper face in engagement with a bottom portion of the basket, wherein the upper face is spaced apart from the bottom portion of the basket.

13. The dishwashing appliance of claim 9, further comprising;

a fluid conduit fixed to the tub within the wash chamber, the fluid conduit extending in fluid communication between the pump and the interior passage, wherein the static body defines an inlet separably connected to the fluid conduit.

14. The dishwashing appliance of claim 13, wherein the fluid conduit includes a resilient bellow extending toward the inlet in fluid communication therewith.

15. The dishwashing appliance of claim 9, wherein the spray assembly is a lower spray arm assembly disposed below the static body.

16. The dishwashing appliance of claim 15, wherein the rack assembly is a lower rack assembly disposed above the lower spray arm assembly, and wherein the dishwashing appliance further comprises:

an upper rack assembly disposed above the lower rack assembly;

an intermediate spray arm assembly disposed between the upper rack assembly and the lower rack assembly; and an upper spray assembly disposed above the upper rack assembly.

17. The dishwashing appliance of claim 9, wherein the rack assembly is an upper rack assembly, and wherein the dishwashing appliance further comprises a lower rack assembly disposed beneath the upper rack assembly to receive a wash fluid directed from the jet aperture.

18. The dishwashing appliance of claim 9, wherein the rack assembly is a lower rack assembly defining a wash compartment to receive a wash fluid directed from the jet aperture, and wherein the dishwashing appliance further comprises an upper rack assembly disposed above the lower rack assembly.

19. The dishwashing appliance of claim 1, wherein the spray assembly is a lower spray arm assembly disposed below the static body.

* * * * *